US006151802A

United States Patent [19]

Reynolds

[11] Patent Number: 6,151,802

[45] Date of Patent: Nov. 28, 2000

[54] CHAIN SAW PROTECTIVE BOOT AND BOOTIE

[76] Inventor: Robert R. Reynolds, 4712 Blakeford Ct., Charleston, S.C. 29420

[21] Appl. No.: 09/333,414

[22] Filed: Jun. 15, 1999

[51] Int. Cl.[7] ..... A43B 23/07

[52] U.S. Cl. ..... 36/55; 36/10; 36/113; 36/72 R

[58] Field of Search ..... 36/10, 55, 45, 36/83, 113, 72 R

[56] References Cited

U.S. PATENT DOCUMENTS

| | | | |
|---|---|---|---|
| 3,827,167 | 8/1974 | Jones | 36/4 |
| 4,428,130 | 1/1984 | Perotto | 36/10 |
| 4,599,810 | 7/1986 | Sacre | 36/55 |
| 5,172,493 | 12/1992 | Diaz | 36/2 R |
| 5,251,386 | 10/1993 | Diaz | 36/2 R |
| 5,272,822 | 12/1993 | Diaz | 36/2 R |
| 5,415,007 | 5/1995 | Eng | 66/192 |
| 5,499,459 | 3/1996 | Tomaro | 36/10 |
| 5,694,703 | 12/1997 | Diaz | 36/7.1 R |
| 5,729,915 | 3/1998 | Khoo et al. | 36/7.1 R |
| 5,925,441 | 7/1999 | Blauer et al. | 36/83 |
| 5,979,081 | 11/1999 | Vaz | 36/72 R |

OTHER PUBLICATIONS

"SAWJAMMER", Timber Harvesting, p. 20 Sep. 1998.

*Primary Examiner*—M. D. Patterson
*Attorney, Agent, or Firm*—Harleston Law Firm; Kathleen M. Harleston

[57] ABSTRACT

A boot or shoe for protecting the wearer from injury from a chain saw, is provided. The invention comprises a boot or shoe, extending to or above the ankle of the wearer; and a flexible, lightweight, chain saw protective liner disposed within the boot or shoe. The liner comprises a plurality of layers of chain saw protective material, which preferably includes polyester and polypropylene fibers. The liner is attached to the inside of the boot or shoe only at the top ankle portion and bottom sole portion of the liner, so that the liner hangs relatively loosely inside the boot or shoe and easily breaks away when struck by a moving chain saw. A removable bootie which is similar to the liner is also included.

10 Claims, 4 Drawing Sheets

CHAIN SAW PROTECTIVE BOOT AND BOOTIE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present invention is a flexible, break-away, chain saw protective liner inside an outer boot, shoe, or the like, for guarding the wearer's foot and ankle against injury from a moving chain saw. More particularly, the free-floating protective liner, which is comprised of multiple layers of chain saw protective material, preferably polyester and polypropylene fibers, is permanently attached at the top and bottom to the inside of the boot or shoe. Alternatively, the free-floating liner can be in the form of a bootie for disposing within a boot. The top of the bootie has a means of attachment to the top of the boot.

2. Background Information

Despite advances in technology, there are still serious injuries each year from chain saws when they are dropped or mishandled. A chain saw can cut through clothing and boots and cause deep cuts or amputations. Efforts to eliminate these injuries include improved safety measures as well as various new materials and devices.

In regard to footwear, a boot which protects against injuries, yet encourages wear by being simple to put on and comfortable to wear, is most desirable. According to the United States Products Safety Commission, there were 2885 injuries to the foot area caused by chain saws in 1994. Certain protective covers for boots and shoes, and steel-toed boots, are known. Many covers and other devices are cumbersome, or complicated to put on, and they can create snagging and tripping hazards while the chain saw operator is working. Some of them do not protect well against injuries.

BRIEF SUMMARY OF THE INVENTION

The present invention protects against injuries from moving chain saws, and encourages use by being comfortable and easy to put on. It is a boot or shoe for protecting the wearer from injury from a chain saw, comprising, in combination:

(a) a boot or shoe, preferably with a protective cap made of steel or the like inserted in the toe of the boot or shoe, extending to or above the ankle of the wearer; and (b) a flexible, lightweight, protective liner disposed within the boot or shoe, the liner comprising a plurality of layers of chain saw protective material;

wherein the liner is attached to the inside of the boot or shoe only at the top, ankle portion and bottom sole portion of the liner, so that the liner hangs relatively loosely inside the boot or shoe and easily breaks away when struck by a chain saw in operation.

The invention further comprises a bootie for wear inside a boot or shoe. The bootie comprises: (a) an inner member of a comfortable material that does not retain moisture, the material comprising synthetic polyester; (b) an outer member comprised of between about two and 12 layers of a chain saw protective material comprising polyester and polypropylene fibers; and (c) a durable outer covering. The bootie includes means for close attachment to the top of the inside of the boot or shoe.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
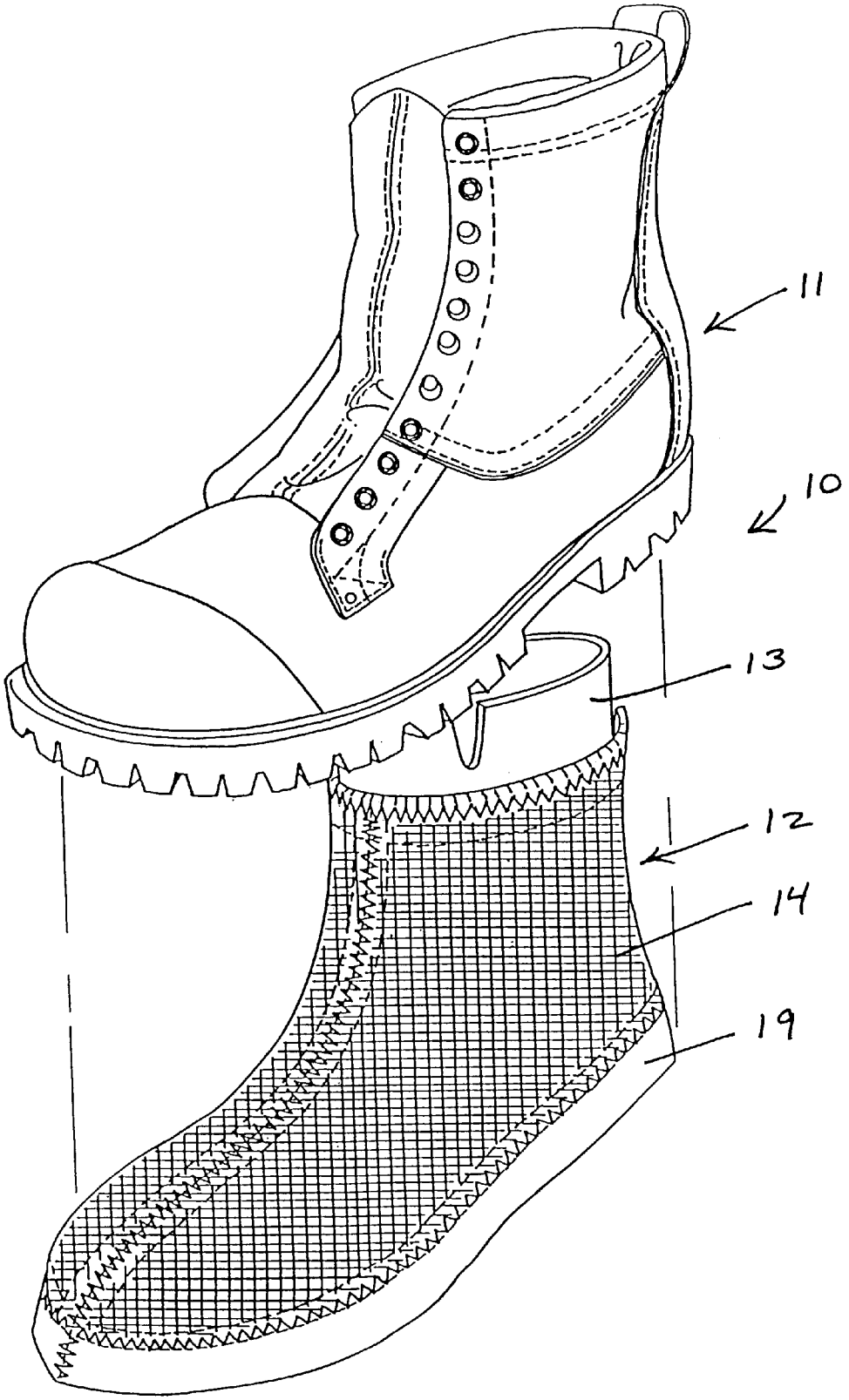
FIG. 1 shows a perspective view of a boot and liner according to the present invention.

In the following description, like reference characters designate like or corresponding parts throughout the several views. Also, in the following description, it is to be understood that such terms as "front," "back," within," and the like are words of convenience and are not to be construed as limiting terms. Referring in more detail to the drawings, the invention will now be described.

Referring to FIG. 1, a protective boot, shoe, or the like according to the present invention is shown. This protective shoe or boot 10 comprises a typical shoe or boot outer 11 and a protective liner 12. The liner 12 is a unitary, lightweight, flexible, multiple layer, substantially fabric body. It is roughly in the shape of a bootie and conforms to the inside of a boot or shoe. The present invention protects the wearer from injury by chain saws, particularly gas-powered chain saws, and reduces the likelihood that a chain saw operator will be injured by a moving saw chain. The chain saw protective liner protects the foot and ankle of its wearer against cuts or amputations by arresting a dropped or mishandled saw chain before it has a chance to harm the foot or ankle.

When a wearer's foot is in the protective boot 10 of the present invention, the liner 12 extends up around the wearer's ankle to the top of the boot. The liner 12 is attached at its top and bottom, but not in between, to the inside of the boot or shoe. The liner 12 is attached only at its top and bottom so that it will "float" between the boot upper and inner lining. This confers a benefit over a boot with a typical liner up against the inside of the boot: the fibers of the present floating liner more easily catch and engage the teeth of the errant chain saw. Once the saw drive mechanism is snagged with the fibers of the protective material of this "break-away" liner, the saw quickly grinds to a halt, which prevents further injury.

The liner 12 is comprised of an inner member 13 and an outer member 14. The inner member 13 is preferably comprised of a breathable synthetic polyester material, which helps to maintain foot comfort by wicking moisture away from the foot.

The outer member 14 is key to protecting the foot from the chain saw. It is comprised of a plurality of, preferably from about three to about 12, layers of a chain saw protective material. The chain saw protective material preferably comprises polyester and polypropylene fibers, and more preferably includes aramide fibers. A highly preferred protective fabric suitable for use herein is described in U.S. Pat. No. 5,415,007, Eng, issued May 16, 1995, incorporated herein. It is a fabric developed for use in chain saw protective garments. It has two layers: a passive, layer, which has thin-diameter threads that support the larger-diameter threads of an active layer. The threads of the passive layer interconnect with and support the threads of the active layer. The threads of the active layer, but not the passive layer, have sinuous, serpentine sections which are caught by the errant saw chain. The threads of the active layer are then easily pulled into the chain saw drive mechanism, causing the saw engine to stall. This fabric comprises: a weft yarn; a warp yarn floating over the weft yarn; and a knitting yam disposed around the weft yarn and the warp yarn. The knitting yarn defines a plurality of restraining stitches. In this fabric, at least one of the weft yarn and the warp yarn is slidingly received through the restraining stitches and defines a serpentine structure having a greater lineal dimension than the surface dimension of the fabric that contains it. The serpentine structure is held by the restraining stitches such that when the fabric is engaged by a saw blade, the serpentine structure readily pulls outwardly from the plane of the fabric through the restraining stitches to restrain the movement of the saw blade.

The layering in the liner 12 is advantageous: the successive layers are more likely to snag in the saw chain, thus stalling the chain saw and decreasing the likelihood of injury. The layering is also lightweight, and breathable. It does not hold moisture on the foot. The layers and the fact that the liner "floats" incidentally allow greater circulation of air in the boot. This enhances safety because the hotter and more uncomfortable a protective boot is, the less likely it is that the chain saw operator will want to wear it for long periods.

Figure 2:
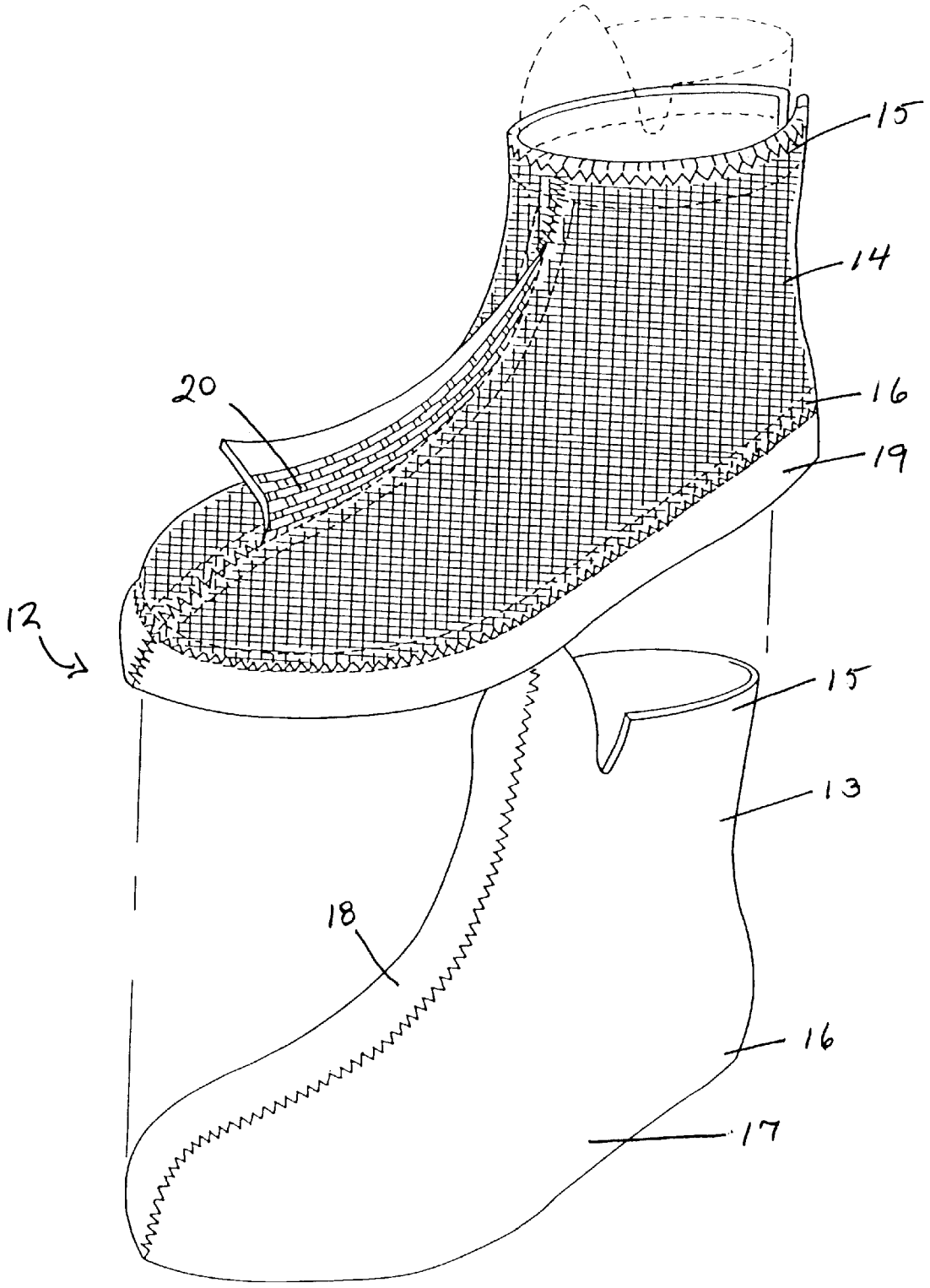
FIG. 2 is a perspective view of a liner according to the present invention, showing inner and outer members.

As shown in FIG. 2, the inner and outer members 13, 14 have a top portion 15, which fits loosely around the ankle when the boot is in use, and a bottom portion 16, which fits along the side of the foot where it meets the sole. The inner member 13 is preferably comprised of two mirror-image pieces of synthetic polyester material: one 17, that fits along the outside of the foot and one 18 that fits along the inside of the foot. The two pieces are each roughly in the shape of a shoe, preferably with a curved top edge; a slightly curved back edge; an L-shaped, front instep edge; and a bottom, sole edge which curves slightly upward at the toe. The two pieces are stitched -up the back edge, which when worn, is adjacent to the heel of the foot, and the front edge. The two front edges meet along the midline of the top of the foot when the foot is in the boot. The two pieces are stitched from the bottom, or sole portion, of the pieces to the top, or ankle portion, of the pieces. Along the top edge, the two pieces have a tongue-shaped extension which fits along the tongue of the boot and affords protection to the front, lower leg just above the ankle.

As shown in FIG. 2, the outer member 14 is also comprised of two pieces, which are preferably approximately the same shape as the two pieces that make up the inner member, except that the top edge of the inner member is relatively straight. Each of the two pieces, though, is preferably made up of about three to twelve layers of protective fabric, each layer lying on top of the next layer. The layers are pre-stitched to each other around the periphery of each piece with a seam of about ¼ inch.

As shown in FIGS. 1 and 2, the outer member 14 of the liner 12 preferably comprises a flared border 19 extending around its bottom periphery. The border 19 is preferably about 1–2 inches in width and made of a strong transition material. The border 19 flares out along the base of the liner 12, allowing it to float more freely, which enhances the likelihood that the layers of the outer member 14 will be caught and engaged in the saw chain and drive mechanism. If the beneficial protective layers were held tautly against the inside of the boot, it is less likely that they would be snagged by the saw chain. The border is also easier to attach between the boot upper and sole than the layered outer member. The bottom portion of the border is preferably lasted or sealed into the seam between the boot upper and the boot sole.

For further protection along the top of the wearer's foot, where chain saw strikes are more common, a protective seam stop 20 is sewn along the front seam. The seam stop is preferably made of a aramide material which comprises both woven and non-woven fabric. At least one piece of woven fabric is layered on at least one piece of non-woven fabric. The non-woven material evidently holds the woven fabric in a structured manner. When the chain saw teeth strike the woven fabric, the threads are more easily disengaged and snarled in the chain saw. A preferred aramide material for use herein is made by E. I. duPont de Nemours and Co.

Figures 3, 4:
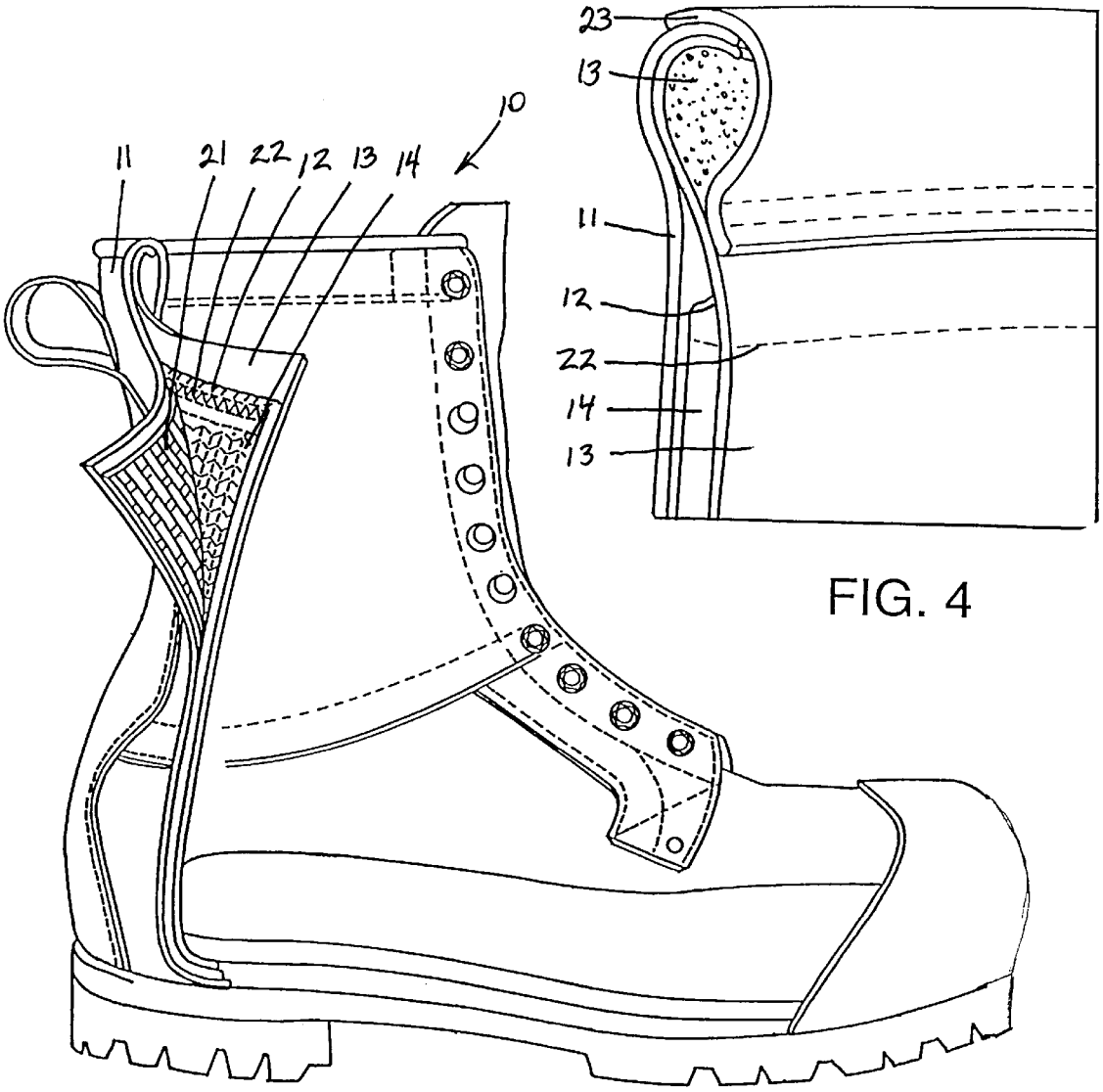
FIG. 3 is a perspective view of a boot with liner according to the present invention.
FIG. 4 is a close-up, perspective view of an upper portion of a boot with liner according to the present invention, showing the attachment to the top of the boot.

Referring to FIG. 3, the present invention preferably includes a third chain saw protective layer 21, preferably a layer of aramide material which is adhered, most preferably glued, to the inside of the boot between the boot outer 11 and the liner 12. This provides additional protection against a chain saw. This aramide-containing layer is furthest from the foot for the comfort of the wearer, since this material can retain heat inside the boot, particularly on warm days, causing the feet to become sweaty. Although the aramide layer also helps to protect the wearer, it does not work the same way that the fabric layers in the outer member work. The aramide layer is cut-resistant, while the fabric of the outer member is caught up by the saw teeth, snarling the chain saw and causing it to shut down.

In FIG. 3, an inside portion of the boot is exposed for viewing. The liner 12 is next to the aramide layer 21. The top stitching 22 of the inner member 13 to the outer member 14 of the liner 12 is shown.

Referring to FIG. 4, a close-up of the top anywhere along the top edge of the boot 10 shows the juncture of the liner 12 and the boot outer 11. In FIG. 4, the inner layer 13 is shown on top, which is the inside of the boot. The stitching 22 of the outer member 14 to the inner member 13 is also shown. The outer member 14 is between the inner member 13 and the boot outer 11. The liner 12 is stitched to the rolled top 23 of the boot. The liner 12 fits over the foot and hangs relatively freely from the top of the boot. The bottom edge of the liner 12, preferably the border, is permanently attached, preferably sewn or lasted, into the seam between the boot outer and the boot sole.

The boot is comprised of an upper and a sole, and the top portion of the liner is preferably permanently attached to the inside of the top of the boot where the boot fits around or above the ankle of the wearer, and the bottom portion of the liner is permanently attached into the seam between the boot upper and the boot sole. The liner is not attached to the boot except at the top and the bottom; it is relatively free-floating. The liner 12 extends completely around the wearer's foot, but typically does not extend across the sole of the foot.

Figure 5:
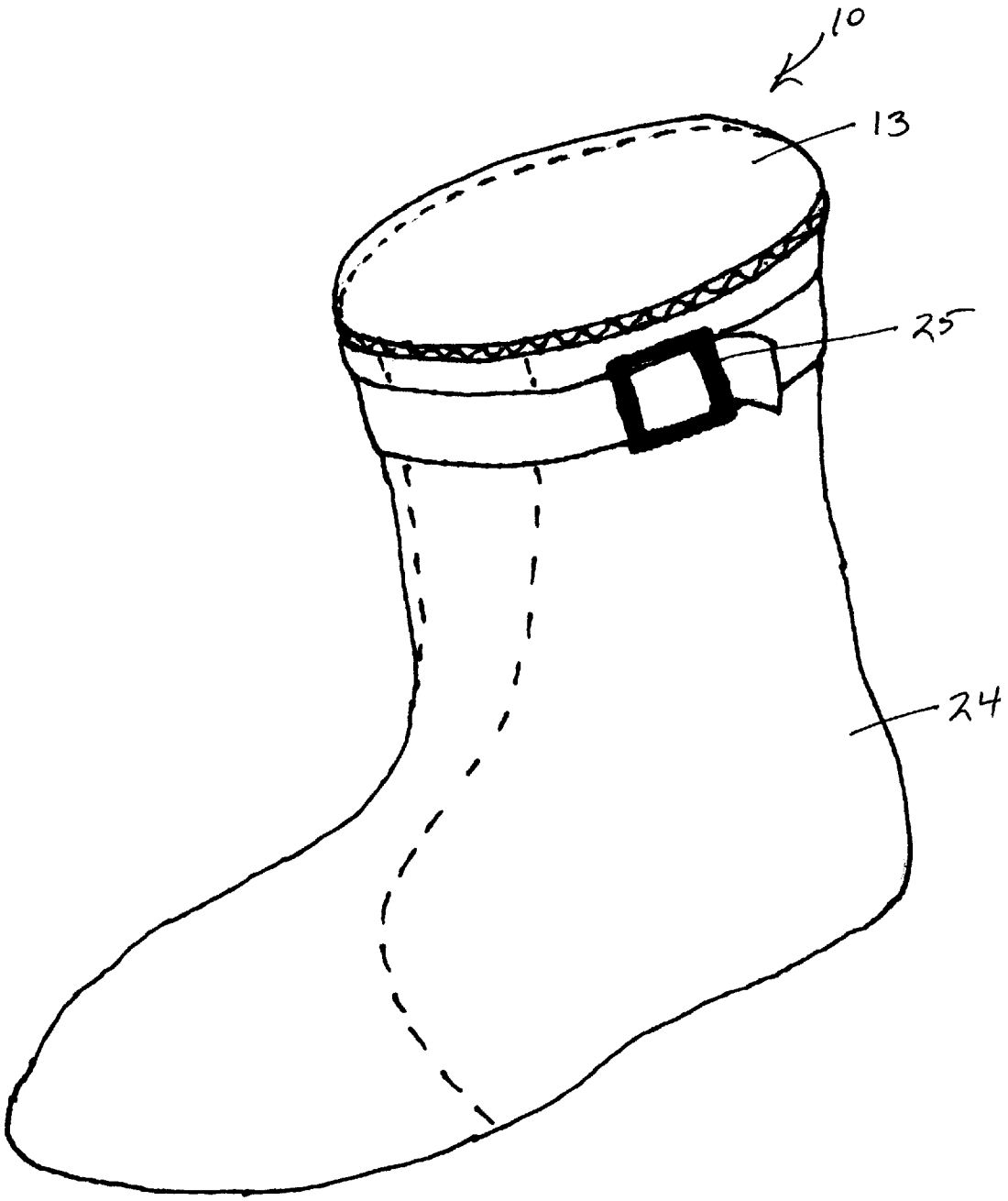
FIG. 5 is a perspective view of a bootie according to the present invention.

The present invention can be a bootie, which would be purchased separately by the user for use with an existing pair of protective boots. This is expected to be more attractive to the household chain saw user, who might be unlikely to purchase a specialized pair of chain saw protective boots. As shown in FIG. 5, the bootie resembles the liner, but with smoother edging. There is preferably a durable outer covering 24 on top of the outer member, such as a polyester, nylon or canvas cover. The top, ankle portion of the bootie would include means for attachment to the ankle, or top portion, of the existing boot, such as a buckle 25 which would fasten around the top of the boot once the foot and bootie were inside a boot. The bootie extends completely around and under the wearer's foot. The sole of the bootie is preferably a durable wool fabric. Although the bootie is not lasted into the bottom of the boot as the liner is, the wearer's body weight holds the bootie relatively taut at the bottom in the case of a chain saw strike.

The bootie is removable and is for protecting the foot and ankle of a wearer from a chain saw in operation (i.e., still moving). The bootie is disposed within a boot or shoe, and comprises: (a) an inner member of a comfortable material that does not retain moisture, the material comprising synthetic polyester; (b) an outer member comprised of between about two and 12 layers of a chain saw protective material comprising polyester and polypropylene fibers; and (c) a durable outer covering. The bootie comprises means for close attachment to the top of the inside of the boot or shoe, such as a buckle, so that the bootie is disposed relatively loosely inside the boot or shoe. The chain saw protective material of the bootie preferably further comprises aramide fibers. The inner member is preferably comprised of between about three and 12 layers of the above-described chain saw protective fabric.

The present invention is not a cover for a boot and does not have complicated straps or buckles for fastening around the outside of a boot or shoe. Unlike a cover, the present invention will not become unfastened or risk failure because it has not been correctly wrapped around the foot. In contrast with a cover, the internal design of the present protective system leaves no snag points or trip hazards for the wearer. Additionally, an internal protective system is itself protected from the elements. The present invention is classifiable as " foot protection for chain saw users in accordance with ASTM F1818."

From the foregoing it can be realized that the described device of the present invention may be easily and conveniently utilized. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

BRIEF LIST OF REFERENCE NUMBERS USED IN THE DRAWINGS

10 boot with liner
11 liner
12 boot outer
13 inner member of liner
14 outer member of liner
15 top portion
16 bottom portion
17 outside portion
18 inside portion
19 border on outer member
20 seam stop
21 aramide layer
22 stitching of inner member to outer member
23 rolled top of the boot
24 outer covering
25 buckle

What is claimed is:

1. A boot or shoe for protecting the wearer from injury from a chain saw, the boot or shoe comprising, in combination:

(a) a boot or shoe extending to or above the ankle of the wearer; and (b) a flexible, lightweight, chain saw protective liner disposed within the boot or shoe, the liner comprising a plurality of layers of chain saw protective material; wherein the liner is attached to the inside of the boot or shoe only at the top ankle portion and bottom sole portion of the liner, so that the liner hangs relatively loosely inside the boot or shoe and easily breaks away when struck by a moving chain saw; and wherein the liner does not extend across the sole of the boot.

2. A combination according to claim 1, wherein the liner is comprised of an inner member and an outer member, the inner member being comprised of a breathable synthetic polyester material, and the outer member being comprised of a plurality of layers, of a chain saw protective material comprising polyester and polypropylene fibers.

3. A combination according to claim 1, wherein the liner is comprised of an inner member and an outer member, the inner member being comprised of a breathable synthetic polyester material, and the outer member being comprised of from about 3 to about 12 layers of a chain saw protective material comprising polyester and polypropylene fibers.

4. A combination according to claim 3, wherein the boot is comprised of an upper and a sole, and wherein the top portion of the liner is permanently attached to the inside of the top of the boot where the boot fits around or above the ankle of the wearer, and the bottom portion of the liner is permanently attached into the seam between the boot upper and the boot sole.

5. A combination according to claim 4, wherein the liner further comprises a flared border extending around its bottom periphery, and the bottom portion of the border is lasted into the seam between the boot upper and the boot sole.

6. A combination according to claim 4, wherein the outer member is comprised of between about three and 12 layers of a chain saw protective fabric, the fabric comprising: a weft yarn; a warp yarn floating over the weft yarn; and a knitting yarn disposed around the weft yarn and the warp yarn, wherein the knitting yarn defines a plurality of restraining stitches; at least one of the weft yarn and the warp yarn is slidingly received through the restraining stitches and defines a serpentine structure having a greater lineal dimension than the surface dimension of the fabric that contains it; and the serpentine structure is held by the restraining stitches such that when the fabric is engaged by a saw blade, the serpentine structure readily pulls outwardly from the plane of the fabric through the restraining stitches to restrain the movement of the saw blade.

7. A boot or shoe for protecting the wearer from injury from a chain saw, the boot or shoe comprising, in combination:

(a) a boot or shoe extending to or above the ankle of the wearer; and (b) a flexible, lightweight, chain saw protective liner disposed within the boot or shoe, the liner comprising a plurality of layers of chain saw protective material; and (c) a layer of aramide material adhered along the inside of the boot, between the boot and the liner; and wherein the liner is attached to the inside of the boot or shoe only at the top ankle portion and bottom sole portion of the liner, so that the liner hangs relatively loosely inside the boot or shoe and easily breaks away when struck by a moving chain saw;

wherein the liner is comprised of an inner member and an outer member, the inner member being comprised of a breathable synthetic polyester material, and the outer member being comprised of from about 3 to about 12 layers of a chain saw protective material comprising polyester and polypropylene fibers;

wherein the boot is comprised of an upper and a sole, and wherein the top portion of the liner is permanently attached to the inside of the top of the boot where the boot fits around or above the ankle of the wearer, and the bottom portion of the liner is, permanently attached into the seam between the boot upper and the boot sole; and wherein the chain saw protective fabric comprises: a weft yarn; a warp yarn floating over the weft yarn; and a knitting yarn disposed around the weft yarn and the warp yarn, wherein the knitting yarn defines a plurality of restraining stitches; at least one of the weft yarn and the warp yarn is slidingly received through the restraining stitches and defines a serpentine structure having a greater lineal dimension than the surface dimension of the fabric that contains it; and the serpentine structure is held by the restraining stitches such that when the fabric is engaged by a saw blade, the serpentine structure readily pulls outwardly from the plane of the fabric through the restraining stitches to restrain the movement of the saw blade.

8. A removable bootie for protecting the foot and ankle of a wearer from a moving chain saw, the bootie being disposable within a boot or shoe, the bootie comprising:

(a) an inner member of a comfortable material that does not retain moisture, the material comprising synthetic polyester;

(b) an outer member comprised of between about two and 12 layers of a chain saw protective material comprising polyester and polypropylene fibers; and (c) a durable outer covering;

wherein the bootie comprises means for close attachment to the top of the inside of the boot or shoe, so that the bootie is disposed relatively loosely inside the boot or shoe.

9. A bootie according to claim 8, wherein the chain saw protective material comprises aramide fibers.

10. A bootie according to claim 9, wherein the outer member is comprised of between about three and 12 layers of a chain saw protective fabric, the fabric comprising: a weft yarn; a warp yarn floating over the weft yarn; and a knitting yarn disposed around the weft yarn and the warp yarn, wherein the knitting yarn defines a plurality of restraining stitches; at least one of the weft yarn and the warp yarn is slidingly received through the restraining stitches and defines a serpentine structure having a greater lineal dimension than the surface dimension of the fabric that contains it; and the serpentine structure is held by the restraining stitches such that when the fabric is engaged by a saw blade, the serpentine structure readily pulls outwardly from the plane of the fabric through the restraining stitches to restrain the movement of the saw blade.

* * * * *